US009482430B2

(12) United States Patent
Clement

(10) Patent No.: US 9,482,430 B2
(45) Date of Patent: Nov. 1, 2016

(54) HOT AIR GENERATOR BURNER WITH INTERCHANGEABLE LIGHTER

(75) Inventor: François Clement, Le Haillan (FR)

(73) Assignee: SEFMAT, Le Haillan (FR)

( * ) Notice: Subject to any disclaimer, the term of this patent is extended or adjusted under 35 U.S.C. 154(b) by 588 days.

(21) Appl. No.: 13/425,915

(22) Filed: Mar. 21, 2012

(65) Prior Publication Data

US 2012/0288808 A1 Nov. 15, 2012

(30) Foreign Application Priority Data

May 11, 2011 (FR) ..... 11 54087

(51) Int. Cl.
*F23Q 3/00* (2006.01)
*F23D 14/38* (2006.01)
*F23D 14/46* (2006.01)

(52) U.S. Cl.
CPC ..... *F23D 14/38* (2013.01); *F23D 14/465* (2013.01)

(58) Field of Classification Search
USPC ..... 431/158
See application file for complete search history.

(56) References Cited

U.S. PATENT DOCUMENTS 1,911,936 A * 5/1933 Armstrong ..... 431/141
2,219,531 A * 10/1940 Racek ..... 431/143
2,444,663 A * 7/1948 Miller, Jr. ..... 431/135
2,529,104 A * 11/1950 Regelmann ..... F23Q 2/02 431/125
2,691,287 A * 10/1954 Mosch ..... F23Q 2/32 431/139
2,691,778 A * 10/1954 Lester ..... 227/128
2,912,841 A * 11/1959 Racek ..... F23Q 2/16 431/125
2,986,208 A * 5/1961 Aceigo ..... 431/276
3,003,053 A * 10/1961 Brooks ..... F21K 5/023 362/14
3,015,023 A * 12/1961 Dayton ..... G03B 15/0442 362/10
3,752,637 A * 8/1973 Norman ..... F23Q 2/08 431/274
4,181,492 A * 1/1980 Zinke ..... 431/264
4,253,820 A * 3/1981 Jarreau ..... 431/344
4,419,072 A * 12/1983 Nakagawa et al. ..... 431/266
5,035,608 A * 7/1991 Parren ..... 431/153
5,082,440 A * 1/1992 Yamamoto ..... 431/143
5,358,151 A * 10/1994 Strasenburgh ..... 222/420
5,437,383 A * 8/1995 Stull ..... 215/235
5,445,479 A * 8/1995 Hillinger ..... 408/16
5,505,614 A * 4/1996 Lin ..... 431/143
5,531,592 A * 7/1996 Tasi ..... 431/255
5,967,768 A * 10/1999 Saito et al. ..... 431/153
6,010,329 A * 1/2000 Zagoroff ..... 431/158
6,128,845 A * 10/2000 Jacobson ..... 42/1.15
6,966,479 B2 * 11/2005 Tanaka et al. ..... 227/144
7,080,768 B2 * 7/2006 Marks ..... 227/120

(Continued)

FOREIGN PATENT DOCUMENTS

FR 2 651 559 A1 3/1991
FR 2 894 325 A1 6/2007
FR 2 945 853 A1 11/2010

OTHER PUBLICATIONS

French Search Report, dated Jan. 2, 2012, from corresponding French application.

*Primary Examiner* — Gregory Huson
*Assistant Examiner* — Martha Becton
(74) *Attorney, Agent, or Firm* — Young & Thompson

(57) ABSTRACT

A heat-shrink gun in which an ignition voltage of the gaseous mixture is generated by a piezoelectric lighter (12), under the action of a trigger (8) when it is moved from a waiting position (8A) to a lighting position, characterized in that the trigger can also assume a loading position (8B), in which it free access (DC) to a working housing for the lighter.

19 Claims, 2 Drawing Sheets

(56) References Cited

U.S. PATENT DOCUMENTS

| | | | | |
|---|---|---|---|---|
| 7,510,095 | B2 * | 3/2009 | Comeau et al. | 215/321 |
| 7,540,400 | B2 * | 6/2009 | Zins et al. | 227/8 |
| 8,256,643 | B2 * | 9/2012 | Uytterhaeghe et al. | 220/836 |
| 8,678,816 | B2 * | 3/2014 | Sarrazy | F23D 14/38 126/61 |
| 2008/0011808 | A1 * | 1/2008 | Melgaard et al. | 227/139 |
| 2008/0302853 | A1 * | 12/2008 | Marks | 227/132 |
| 2009/0050669 | A1 * | 2/2009 | Zolentroff | 227/129 |
| 2009/0075221 | A1 * | 3/2009 | Bouvier et al. | 431/254 |
| 2009/0114698 | A1 * | 5/2009 | Marks | 227/132 |
| 2009/0159636 | A1 * | 6/2009 | Shen | 227/108 |
| 2009/0283609 | A1 * | 11/2009 | Strand | 239/333 |
| 2010/0081105 | A1 * | 4/2010 | Guillou et al. | 432/47 |
| 2010/0297567 | A1 * | 11/2010 | Guillou et al. | 431/254 |
| 2012/0244480 | A1 * | 9/2012 | Tsai | 431/153 |
| 2012/0288809 | A1 * | 11/2012 | Clement | 431/158 |

* cited by examiner

HOT AIR GENERATOR BURNER WITH INTERCHANGEABLE LIGHTER

BACKGROUND OF THE INVENTION

1. Field of the Invention

The present invention relates to a burner/hot air generator device with a riser, usable in particular, but not exclusively, for low-temperature heating of a plastic film, for example a polyethylene film, for the retraction thereof using a gas flow coming from the combustion of a combustible gas such as propane and air or to place thermoplastic material on the ground. These devices are generally referred to as heat-shrink guns.

2. Description of the Related Art

A heat-shrink gun is essentially made up of a tap actuated by a trigger to supply a venturi, from an external gas source, for example a GPL, at a pressure greater than atmospheric pressure. An "atmospheric gas-air" flammable mixture forms in the venturi and emerges in an ignition chamber. The gaseous mixture thus formed is ignited at the terminals of a spark plug by a spark whereof the electric energy is produced by an electric piezoelectric lighter situated inside the gun and actuated when the trigger is pushed in.

The lighter, with time, delivers a weaker and weaker voltage that leads to user to have to actuate the trigger several times to obtain ignition. Changing the lighter requires the intervention of a technician, often an outside one, which in that case immobilizes the equipment for several days. This gun generally being crucial to the daily shipment of a business's production, it is often observed that users prefer to lose time with lighting difficulties rather than be separated from their gun, which would lead to no longer being able to shrink packaging, therefore making it impossible for them to ship their production in due time.

BRIEF SUMMARY OF THE INVENTION

The invention therefore more particularly aims to eliminate these drawbacks. To that end, it proposes a hot air device of the type whereof a body comprises an injection device capable of producing a combustible gaseous mixture flow at high speed, in which an ignition voltage of the gaseous mixture is generated by a piezoelectric lighter, under the action of a trigger when it is moved from a waiting position to a lighting position, characterized in that it comprises means for changing the lighter without tools, i.e. removing the lighter from its working housing or inserting it therein without tools.

Advantageously, these means can comprise the trigger, the trigger being able to assume a loading position, in which it frees access to the working housing for the lighter.

The trigger is advantageously pivotably mounted around a trigger axis and in that the loading position is in an over-tilted position relative to the waiting position, opposite the lighting position.

The device can comprise retractable stop means, by clipping or snapping, for the trigger, preferably for an end of the trigger remote from the trigger axis.

Advantageously, the device comprises at least one zone for storing a spare lighter. This storage zone can be formed in the thickness of a guard for the trigger. It can also be formed in a boss of the body. The storage zone can comprise a housing for the spare lighter advantageously sized so that the lighter is maintained therein compressed longitudinally, preferably between an access hatch and a bottom of the housing.

This device can be of the heat-shrink gun type.

BRIEF DESCRIPTION OF THE DRAWINGS

Embodiments of the invention will be described below, in reference to the appended drawings, in which.

DETAILED DESCRIPTION OF THE PREFERRED EMBODIMENTS

Figure 1:
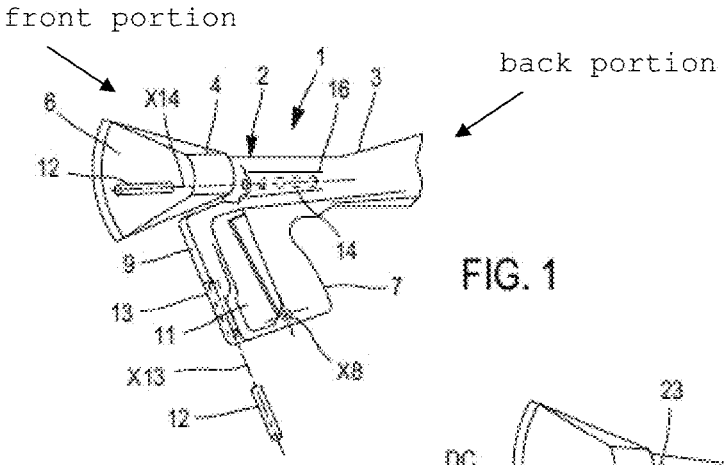
FIG. 1 is a diagrammatic profile view of a device according to the invention illustrating possible storage zones for one or more spare lighters.

In the examples illustrated in the figures, a device 1 according to the invention comprises a body 2, the body 2 comprising an injection device 3 and a head 4. The injection device 3 can transmit, to the head 4 of the device 1, a combustible gaseous mixture flow. The head 4 is extended forward by a nozzle 6 flaring in the shape of a paddle. The device also comprises a handle 7 mounted secured to the body 2, so that the device is substantially in the shape of a gun. The device also comprises a trigger 8 hingedly mounted in the handle 7, around a trigger axis X8. The trigger is mounted so that it is accessible at the front of the handle 7. The axis X8 is positioned at one end of the handle remote from the body 2. The trigger is protected by a guard 9 extending to the front of the handle 7. The handle 7 and the guard 9 form a passage 11 between them for the deployment of the trigger and the passage of an operator's fingers. In the following description, the front and bottom are defined so that the nozzle 6 is at the front of the body 2, and the handle 7 extends toward the bottom from the body 2.

The trigger is provided to actuate a piezoelectric lighter 12 housed in the handle 7. In the figures, no lighter is shown in this usage position, inside the handle. When the trigger 8 is actuated, the lighter provides a spark plug (not shown) situated in the head 4 with a high enough voltage to allow ignition of the gaseous mixture.

For the device always to remain available when the lighter wears out, the invention proposes means for quickly changing this lighter out for another. Advantageously, as illustrated in FIG. 1, this other lighter is stored on the device itself, which allows it to be available immediately.

Thus, as illustrated in FIG. 1, one or more storage zones 13, 14 can be formed in the device.

A first storage zone 13 is formed in the thickness of a portion of the guard 9 substantially parallel to the handle 7. This first storage zone is more particularly illustrated in FIGS. 3 and 4. A lighter 12 can be inserted therein or removed therefrom, from the bottom, along an axis X13 substantially parallel to the handle 7.

A second storage zone 14 is formed in a boss 16 made to that end on the body 2 of the device 1. A lighter 12 can be inserted therein or removed therefrom, through the front of the boss, along an axis X14 substantially parallel to the body.

Figure 3:
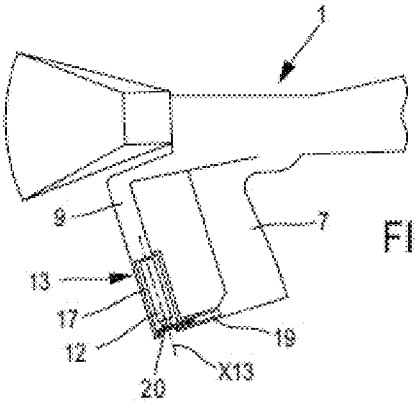
FIGS. 3 and 4 illustrate an embodiment for the storage and removal of a lighter, in one of the zones illustrated in FIG. 1.
Figure 4:
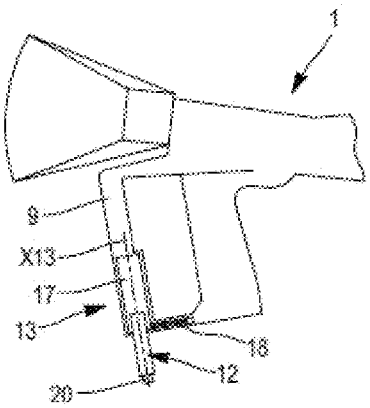

As particularly illustrated in FIGS. 3 and 4, the first storage zone comprises a substantially cylindrical housing 17 around the axis X13. The housing 17 is formed in the thickness of the guard. Its lower end is closed by a sliding hatch 18 transverse to the axis X13. The hatch is slidingly mounted in a branch 19 of the guard 9 connecting the guard 9 to the bottom of the handle 7.

Each lighter comprises a piston 20 longitudinally movable under the action of the trigger, so as to generate voltage by compressing a piezoelectric quartz; each lighter also comprises means for returning the piston to its extended position. This return capacity is used to keep the lighter in the housing 17. Thus, the depth of the housing 17 is such that the lighter is maintained therein longitudinally compressed between the hatch 18 and the bottom of the housing opposite the hatch. In this way, it is the return force exerted by the piston against the hatch 18 that keeps the hatch closed and limits the travel of the lighter 12 in the housing 17.

Figure 2:
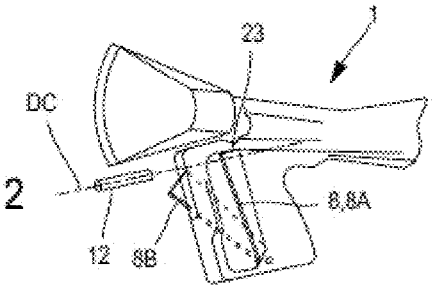
FIG. 2 is a diagrammatic profile view of a device according to the invention illustrating the replacement of a lighter.

As particularly illustrated in FIG. 2, the trigger 8 can move between a waiting position 8A and a lighting position in which the trigger is pushed in backward, inside the handle 7; the lighting position is not shown in the figures. To ignite the gaseous mixture, the operator exerts pressure on the trigger 8 from front to back; the lighter in use, placed in a working housing at the back of the trigger, is thus compressed by an upper end 23 of the trigger furthest from the axis X8; the lighter thereby generates the voltage necessary to ignite the gaseous mixture. Return means make it possible to keep the trigger in the waiting position 8A in the absence of bearing by the user.

According to the invention, the trigger can also assume a loading position 8B. In the illustrated examples, as particularly in FIG. 2, in broken lines, the loading position 8B is a position in which the trigger 8 is tilted forward. In that position, the trigger frees a passage to be able to load or remove a lighter from its working housing, in a direction DC (see FIG. 2), from the front of the handle, near the body 2.

According to the invention, an abutment 24, 25 is provided at the front of the upper end 23 of the trigger 8, so as to prevent it from over-tilting forward, under the action of its return means. FIGS. 5 to 8 show a device with a cutaway near its abutment, so as to show the details thereof.

Figure 5:
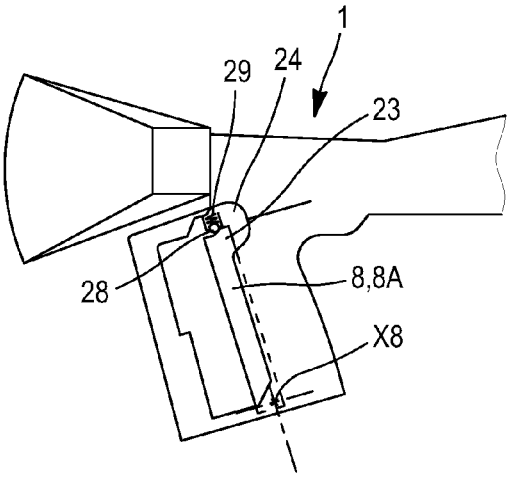
FIGS. 5 and 6 diagrammatically illustrate a first embodiment for maintaining a trigger for a device according to the invention.
Figure 6:
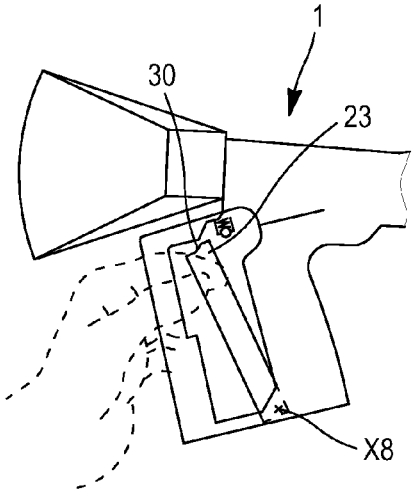

In the embodiment of FIGS. 5 and 6, the abutment 24 is formed by a bead 28 substantially radially movable relative to the trigger axis X8. A spring 29 tends to push the bead 28 toward the axis X8. The upper end 23 assumes the form of a ramp across from the abutment, so that forward traction on the trigger, as illustrated in FIG. 6, tends to push the bead back against the spring, until the trigger is released and it is allowed to over-tilt into its loading position. In this way, the trigger is thus maintained by clipping.

Figure 7:
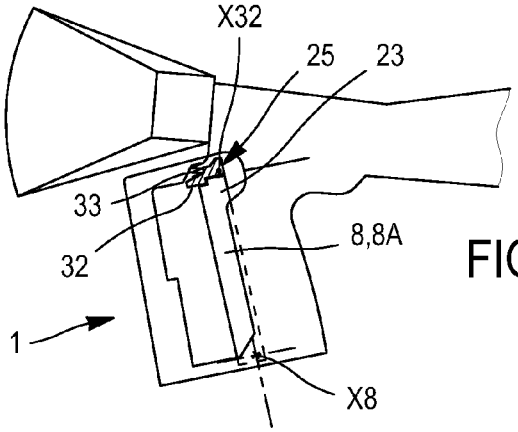
FIGS. 7 and 8 diagrammatically illustrate a second, preferred embodiment for maintaining a trigger for a device according to the invention.
Figure 8:
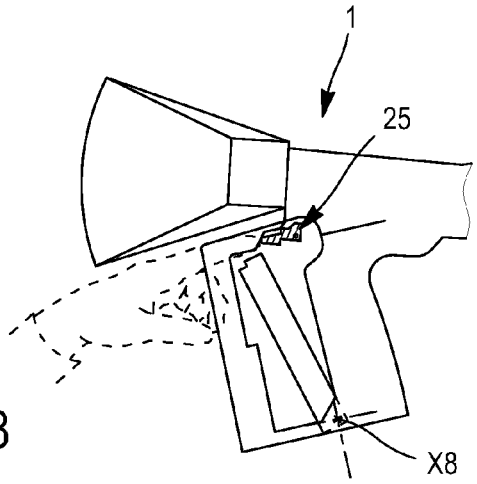

According to the alternative and preferred embodiment of FIGS. 7 and 8, the abutment 25 is formed by a pawl 32, able to move around a pawl axis X32 parallel to the trigger axis X8 and positioned above the upper end 23 of the trigger 8. The pawl 32 comprising a shoulder provided to cooperate with a complementary shoulder of the end 23 when the trigger is in its waiting position 23. A spring 33 tends to keep the pawl tilted against the end 23. Positive action is therefore necessary by the operator, against the spring 33, as illustrated in FIG. 8, to free the trigger and be able to over-tilt it in its loading position 8B. In this way, the trigger is maintained by clicking.

Of course, the invention is not limited to the preferred embodiments just described; on the contrary, the invention is defined by the claims that follow.

One skilled in the art will in fact see that various modifications can be made to the embodiments described above, in light of the teaching just disclosed.

Thus, the loading position of the trigger may not be over-tilting forward. The trigger can be designed so that at least part thereof slides radially relative to the axis of rotation of the trigger, thereby freeing the passage for the insertion or removal of a lighter.

The invention claimed is:

1. A hot air device comprising:

a head provided at a first, front portion of the device;

a body adjacent to the head and including a second, back portion of the device opposite the first portion of the device, the body comprising an injection device configured to produce a combustible gaseous mixture flow at high speed, an ignition voltage of the gaseous mixture being generated by a piezoelectric lighter;

a handle secured to the body and having a passage configured to receive the lighter therein; and a trigger hingedly mounted with the handle, the trigger being configured to pivot about a pivot axis between a first, waiting position, a second, lighting position in which the trigger is compressed backward about the pivot axis inside the handle from the first position to compress the lighter housed in the handle, and a third, loading position in which the trigger remains pivotally connected with the handle and is pivoted in a forward direction toward the front portion of the device to open or close access to the passage from the forward direction for removal or insertion of the lighter from the passage in the forward direction.

2. The device according to claim 1, wherein the third, loading position is in an over-tilted position relative to the first, waiting position, opposite the second, lighting position.

3. The device according to claim 2, further comprising retractable stop means by clipping to stop the trigger.

4. The device according to claim 1, further comprising at least one zone configured to store a spare lighter.

5. The device according to claim 4, wherein the at least one zone includes a first storage zone formed in the thickness of a guard for the trigger.

6. The device according to claim 4, wherein the at least one zone includes a storage zone formed in a boss of the body.

7. The device according to claim 4, wherein the storage zone comprises a housing for the spare lighter sized so that said spare lighter is maintained therein compressed longitudinally.

8. The device according to claim 1, wherein the hot air device is a heat-shrink gun.

9. The device according to claim 2, further comprising at least one zone configured to store a spare lighter.

10. The device according to claim 3, further comprising at least one zone configured to store a spare lighter.

11. The device according to claim 5, wherein the at least one zone includes a second storage zone formed in a boss of the body.

12. The device according to claim 5, wherein the first storage zone comprises a housing for the spare lighter sized so that said spare lighter is maintained therein compressed longitudinally between an access hatch and a bottom of the housing.

13. The device according to claim 6, wherein the storage zone comprises a housing for the spare lighter sized so that said spare lighter is maintained therein compressed longitudinally.

14. The device according to claim 3, wherein the retractable stop means is configured to stop an end of the trigger remote from the trigger axis.

15. The device according to claim 2, further comprising retractable stop means by snapping to stop the trigger.

16. The device according to claim 15, wherein the retractable stop means is configured to stop an end of the trigger remote from the trigger axis.

17. The device according to claim 7, wherein the spare lighter housing is sized so that the spare lighter is maintained therein compressed longitudinally between an access hatch and a bottom of the housing.

18. A hot air device comprising:

a body comprising an injection device configured to produce a combustible gaseous mixture flow at high speed, an ignition voltage of the gaseous mixture being generated by a piezoelectric lighter;

a handle secured to the body and having a passage configured to receive the lighter therein and configured to permit removal of the lighter from a lighter housing; and a trigger hingedly mounted with the handle, the trigger being configured to cause the piezoelectric lighter to generate the ignition voltage when the trigger is pivoted from a waiting position to a lighting position, the trigger being configured to pivot about a pivot axis to open or close access to the passage for removal or insertion of the lighter without causing detachment from the handle.

19. A hot air device comprising:

a body comprising an injection device configured to produce a combustible gaseous mixture flow at high speed, an ignition voltage of the gaseous mixture being generated by a piezoelectric lighter, the body including a second storage zone configured to receive and store the piezoelectric lighter therein when the lighter is not disposed within the handle passage;

a handle secured to the body and having a passage configured to receive the piezoelectric lighter therein and configured to permit removal of the piezoelectric lighter from a lighter housing;

a guard extending to the front of the handle and including a first storage zone defined in the guard, the first storage zone being configured to receive and store the piezoelectric lighter therein when the lighter is not disposed within the handle passage; and a trigger hingedly mounted with the handle, the trigger being configured to cause the piezoelectric lighter to generate the ignition voltage when the trigger is pivoted from a waiting position to a lighting position and the piezoelectric lighter is in the handle passage, the trigger being configured to open or close access to the handle passage for removal or insertion of the piezoelectric lighter.

* * * * *